US010714062B2

(12) United States Patent
Welch et al.

(10) Patent No.: US 10,714,062 B2
(45) Date of Patent: Jul. 14, 2020

(54) TENSIONING SYSTEM FOR VIBRATING MEMBRANES

(71) Applicants: Samuel Justin Welch, Englewood, CO (US); Patrick B. Auell, Morrison, CO (US)

(72) Inventors: Samuel Justin Welch, Englewood, CO (US); Patrick B. Auell, Morrison, CO (US)

(73) Assignee: WELCH TUNING SYSTEMS, INC., Englewood, CO (US)

( * ) Notice: Subject to any disclaimer, the term of this patent is extended or adjusted under 35 U.S.C. 154(b) by 0 days.

(21) Appl. No.: 16/120,866

(22) Filed: Sep. 4, 2018

(65) Prior Publication Data

US 2019/0088236 A1 Mar. 21, 2019

Related U.S. Application Data

(60) Provisional application No. 62/560,060, filed on Sep. 18, 2017.

(51) Int. Cl.

| | |
|---|---|
| ***G10D 13/02*** | (2020.01) |
| ***G10D 13/16*** | (2020.01) |
| ***G10D 13/20*** | (2020.01) |
| ***G10D 13/22*** | (2020.01) |

(52) U.S. Cl.

CPC ..... *G10D 13/02* (2013.01); *G10D 13/16* (2020.02); *G10D 13/20* (2020.02); *G10D 13/22* (2020.02)

(58) Field of Classification Search

CPC ..... G10D 13/02; G10D 13/22; G10D 13/20; G10D 13/16

See application file for complete search history.

(56) References Cited

U.S. PATENT DOCUMENTS

| | | | |
|---|---|---|---|
| D216,049 | S | 11/1969 | Dreyer |
| D250,222 | S | 11/1978 | Clark et al. |
| 4,422,742 | A | 12/1983 | Enomoto |
| D279,103 | S | 6/1985 | Ayotte |
| 4,709,613 | A | 12/1987 | Powers et al. |
| 5,684,258 | A | 11/1997 | Liao |
| D483,795 | S | 12/2003 | Morgan et al. |

(Continued)

OTHER PUBLICATIONS

International Search Report and Written Opinion from International Patent Application No. PCT/US20181049350 dated Nov. 15, 2018 in 8 pages.

*Primary Examiner* — Kimberly R Lockett
(74) *Attorney, Agent, or Firm* — Stephen Katsaros

(57) ABSTRACT

A cable and pulley or guide apparatus for accurately tuning and securing a tunable vibrating membrane on a cylindrical shell by means of a plurality of either fixed-angle pulley or guide assemblies not parallel to the top-bottom axis of the shell, or adjustable-angle pulley or guide assemblies not parallel to the top-bottom axis of the shell, built into or attached to purpose built hoops, attached to hoops with protruding flanges through holes or slots, or attached to a claw or hook apparatus which secures over the edge of annular hoops, through which a cable is laced and fed into the tensioning mechanism(s) to increase or decrease the tension on the cable, thus tensioning the vibrating membrane or heads against the shell, the angles of the pulley or guide assemblies adjustable to conform to the natural angle of the cable traversing the circumference of the shell.

21 Claims, 19 Drawing Sheets

(56) References Cited

U.S. PATENT DOCUMENTS

| | | | | |
|---|---|---|---|---|
| D506,918 | S | 7/2005 | Nakajima | |
| 7,888,575 | B1 | 2/2011 | Toscano | |
| 7,943,840 | B2 | 5/2011 | Yoshino et al. | |
| D674,002 | S | 1/2013 | Ginter | |
| D703,261 | S | 4/2014 | Hudson | |
| D765,766 | S | 9/2016 | Steinberger | |
| D787,585 | S | 5/2017 | Allen | |
| D817,386 | S | 5/2018 | Graham | |
| D832,336 | S | 10/2018 | Suzuki | |
| 2010/0269669 | A1 | 10/2010 | O'Connor | |
| 2015/0243268 | A1 | 8/2015 | Miyajima | |
| 2016/0240175 | A1* | 8/2016 | Bedson | G10D 13/023 |
| 2019/0088236 | A1 | 3/2019 | Welch et al. | |

* cited by examiner

*Fig. 1*
FIG. 1A
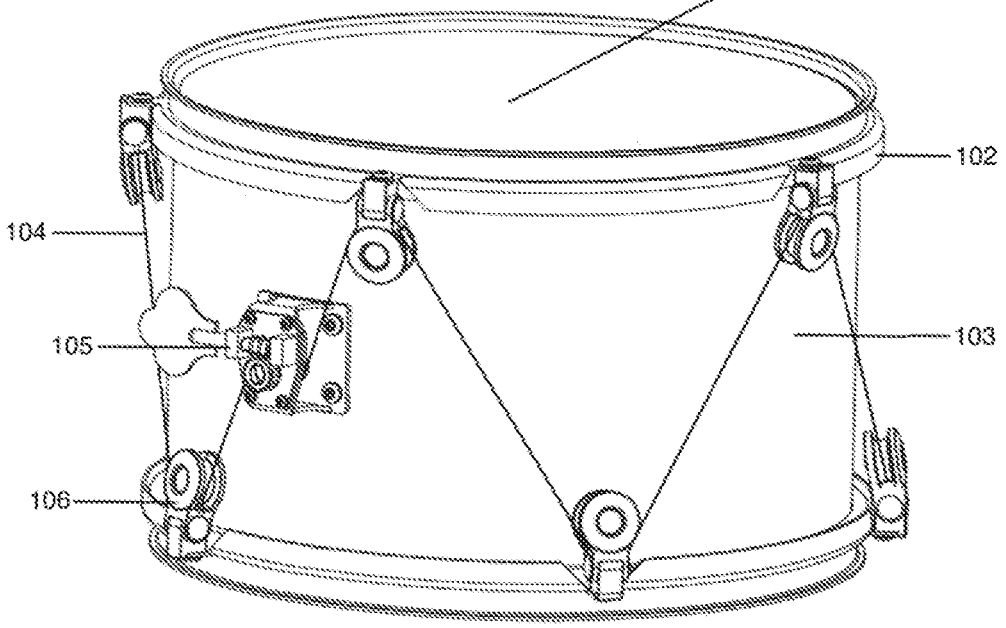
FIG. 1B
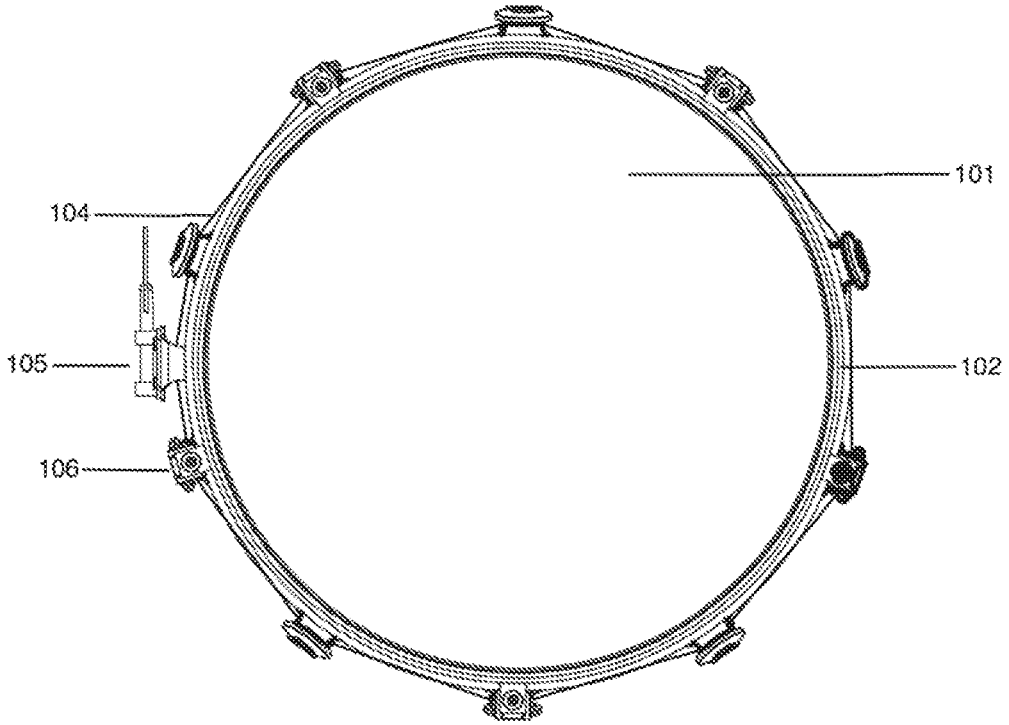

*Fig. 3*
FIG. 3A
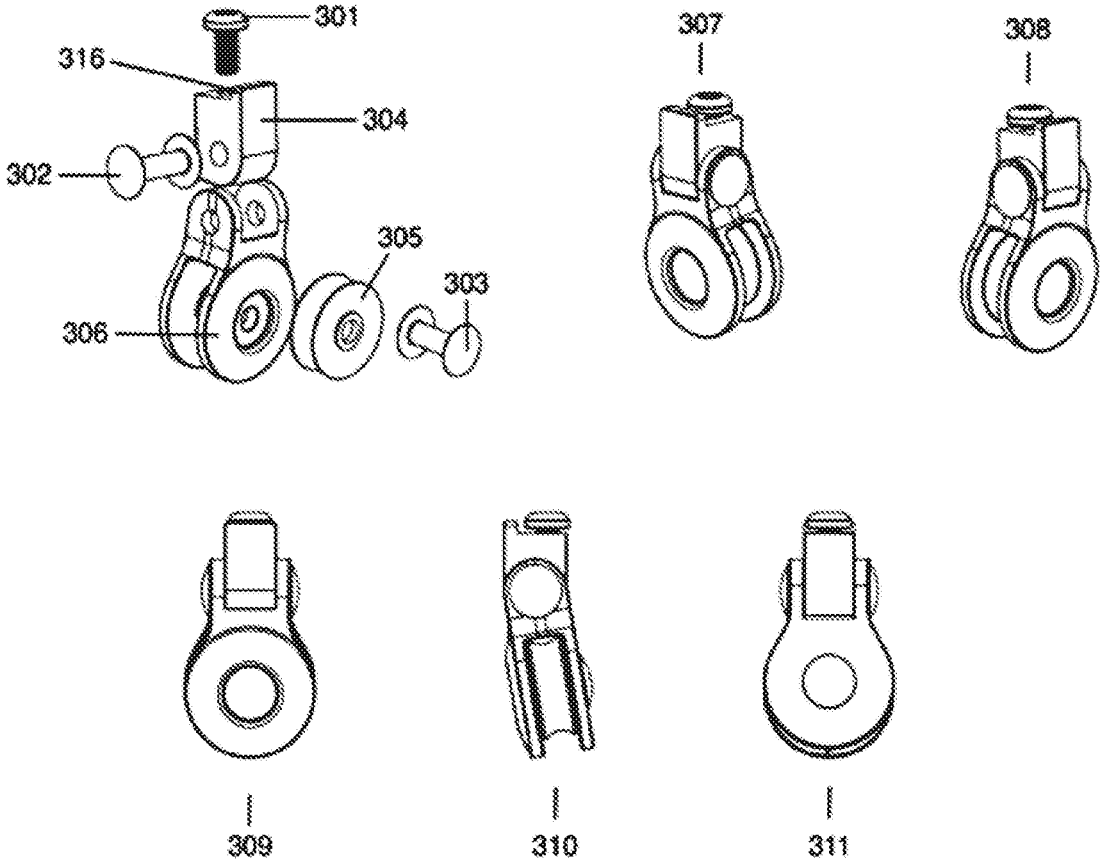
FIG. 3B
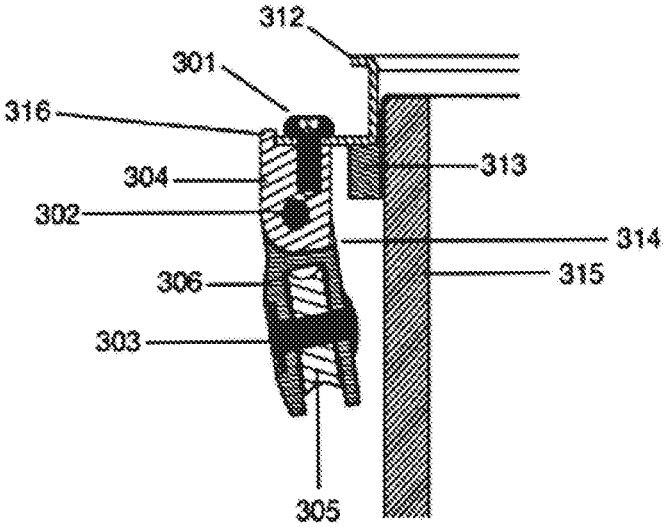

*(Prior Art)*
U.S. Patent No. 9,006,548 (Bedson) Fig. 4

*(Prior Art)*

TENSIONING SYSTEM FOR VIBRATING MEMBRANES

BACKGROUND

In relation to musical drums, regardless of the type of drum, the heads must be properly tensioned (or tuned) prior to playing. Traditional drum head tensioning systems (FIG. 13) involve a system of threaded tension rods 42 and brackets 40. The brackets 40, with interior female threading, are bolted into the exterior of the shell of the drum 10. The tension rods 44, with exterior male threading 42, are inserted through holes in a tensioning hoop 50 that is secured over the rim of the drum head 20. The tension rods 44 are then individually screwed into the brackets 40 on the shell 10. When the drum is tuned, each tension rod 44 is individually tightened, and the drum head tuned overall by means of hitting the drum head 20 with a drum stick or tapping on the drum head near each tension rod 44 individually and gradually bringing the entire drum head up to the desired tension and its associated tone.

Since tightening of any single tension rod affects overall tension, this process must be repeated a number of times to bring the head to final tension. If the drum has a head on each end, this entire process is repeated for both heads. This approach has several downsides: attachment of the brackets to the drum shell requires penetrating the shell with a large number of holes, which may adversely affect sound, and which adds significantly to the cost of manufacture. More importantly, the drum cannot readily be tuned during performance, since the tap-and-tighten approach to tuning is time consuming and requires a reasonably quiet environment to be able to hear the tone at each individual tension rod. When a drum head is struck near the rim or tension rod, the volume is much lower than hitting the drum in the center of the drum head. Hitting the drum head in the center to check the overall tuning is only useful after all tension rods are adjusted equally. In the case of the bottom head, it would also require removing the drum from its stand and flipping it over to repeat the process. Neither the requisite time or the quiet environment are likely to be available in a live music venue, making tuning or re-tuning during a performance effectively impossible. These issues are also generally present in other musical instruments with a similar membrane-shell architecture.

Prior attempts to develop a cable tensioned drum tuning apparatus are impractical or flawed for several reasons:

They involve very complex mechanisms with a great number of moving parts which are sensitive to mis-adjustment, and therefore impractical for the needs of performing percussionists (see U.S. Pat. No. 9,349,355 FIG. 2).

They require drums that are purpose-built to take the specific tuning mechanism in question, and are therefore useless to the percussionist using a standard drum kit (see U.S. Pat. No. 7,488,882).

They require bulky components or separate hand tools (see U.S. Pat. No. 795,034).

They involve a pulley housing apparatus which is fixed parallel to the top-bottom axis of the drum shell and does not allow the pulley to follow the angle at which the cable is traversing the circumference of the drum shell (FIG. 10 prior art—pulley lies fixed parallel to the drum shell, resulting in the cable winding across the pulley at a skewed angle), and (FIG. 1 showing the path of cable traversing the circumference of the drum, and illustrating that in traversing the circumference of the drum, the cable cannot leave a parallel pulley on an axis perpendicular to the pulley axis when the pulley is parallel to the drum shell.) In this last case, the skewed angle at which the cable passes through the pulley induces uneven stresses on both the pulley assembly and cable. Any cable tensioning system that uses pulley assemblies that do not account for this phenomenon creates higher friction resulting in uneven cable tension and therefore uneven drum head tension throughout the circumference of the drum, resulting in poor tuning. Further, the exit of the cable from the pulley at an angle that is not perpendicular to the axis of the pulley exerts uneven force on the pulley, its shaft and its housing. Drum heads are tuned to very high tensions, and this uneven force inevitably leads to uneven wear of the pulley axle shaft, deformation of the pulley assembly and the housing, and to premature failure of the entire pulley assembly. This is a particularly undesirable trait in drums. They are used very roughly and very often, and in circumstances where major repairs are not possible, so durability and reliability are highly prized qualities.

SUMMARY

The present invention is readily distinguishable from prior drumhead tensioning systems of all kinds and avoids all of these downsides.

When set up in a configuration using a single run of cable (FIG. 1), both heads on the drum are tensioned simultaneously with a single adjustment point. The cable is threaded between top and bottom hoops through a plurality of angled pulley or guide assemblies, then fed into the tensioning mechanism. The single run of cable configuration is the simplest, offers the smallest number of moving parts, and the only penetration of the drum shell is the tensioning mechanism mounting bracket. Because the drum is being tuned as a whole, the tone of the drum can be heard by striking the center of the drum head instead of at each individual tension rod, which is much louder, thus allowing easier tuning in a noisy environment. This configuration also eliminates the need to remove the drum to check tension on the bottom drum head since the tension on the top and bottom drum heads are tuned simultaneously.

In another configuration (FIG. 15), the present invention can be applied to independently tunable top and bottom heads or single headed drums using a duplicate system relating to each drum head individually with the addition of angled pulley or guide assemblies mounted to the drum shell itself 1501.

The only hardware items needed are: angled pulley or guide assemblies, tensioning mechanism, tensioning mechanism mounting bracket and cable. The angled pulley or guide assembly can attach to both standard and modified drum hoops. This means that in addition to being used on new drums, it can be retrofitted to an existing drum with no modification of the drum hoops and little or no modification of the drum shell itself. And it does this using the standard hoops that any drum will have, thus eliminating the need to replace all of the hoops on an entire drum kit—two for each shell—with new, custom hoops.

Unlike a traditional tension rod-and-bracket system (FIG. 13), the current invention may or may not use brackets attached to the drum shell and uses no tension rods at all. This also eliminates the need for a drum key or any other separate hand tool to tune the drum.

Unlike prior cable systems (FIG. 10), this system permits the angle of the pulley housing to be parallel to the natural path of the cable as it traverses any size shell, not parallel to the top-bottom axis of the shell, so it provides for inherently more accurate tuning, as well as significantly enhancing the reliability of the overall system.

Should a pulley assembly fail, replacement of it is a simple matter of unbolting the old one, bolting on a new one and re-tensioning the cable. Because the individual pulley assemblies are modular, keeping spares with the drum kit is likewise both easy and cheap—akin to a guitarist carrying extra strings, or a drummer extra sticks—further adding to the overall utility of the system.

The present invention can be applied any drum with a tunable vibrating membrane such as: hand percussion, concert percussion and marching percussion, as well as any other instrument with a tunable vibrating membrane, such as: a banjo or sitar in which the resonating chamber of the instrument is essentially a flattened drum shell and head assembly with hoops and lugs.

Other systems, methods, features, and advantages of the present disclosure will be or become apparent to one with skill in the art upon examination of the following drawings and detail description. The features, functions and advantages that have been discussed can be achieved independently in various embodiments of the present invention or may be combined in yet other embodiments further details of which can be seen with reference to the following description and drawings.

BRIEF DESCRIPTION OF THE DRAWINGS

FIG. 1 illustrates the overall layout of the basic variation of the invention from side (FIG. 1A) and overhead (FIG. 1B) views on a cylindrical shell, as well as the relation of the cable's natural angle to the shell as it traverses the circumference of the shell.

FIG. 3 shows detailed views on hoops with protruding flanges bolt-on version of the adjustable-angle pulley assembly.

DETAILED DESCRIPTION

Figures 2, 2A, 2B:
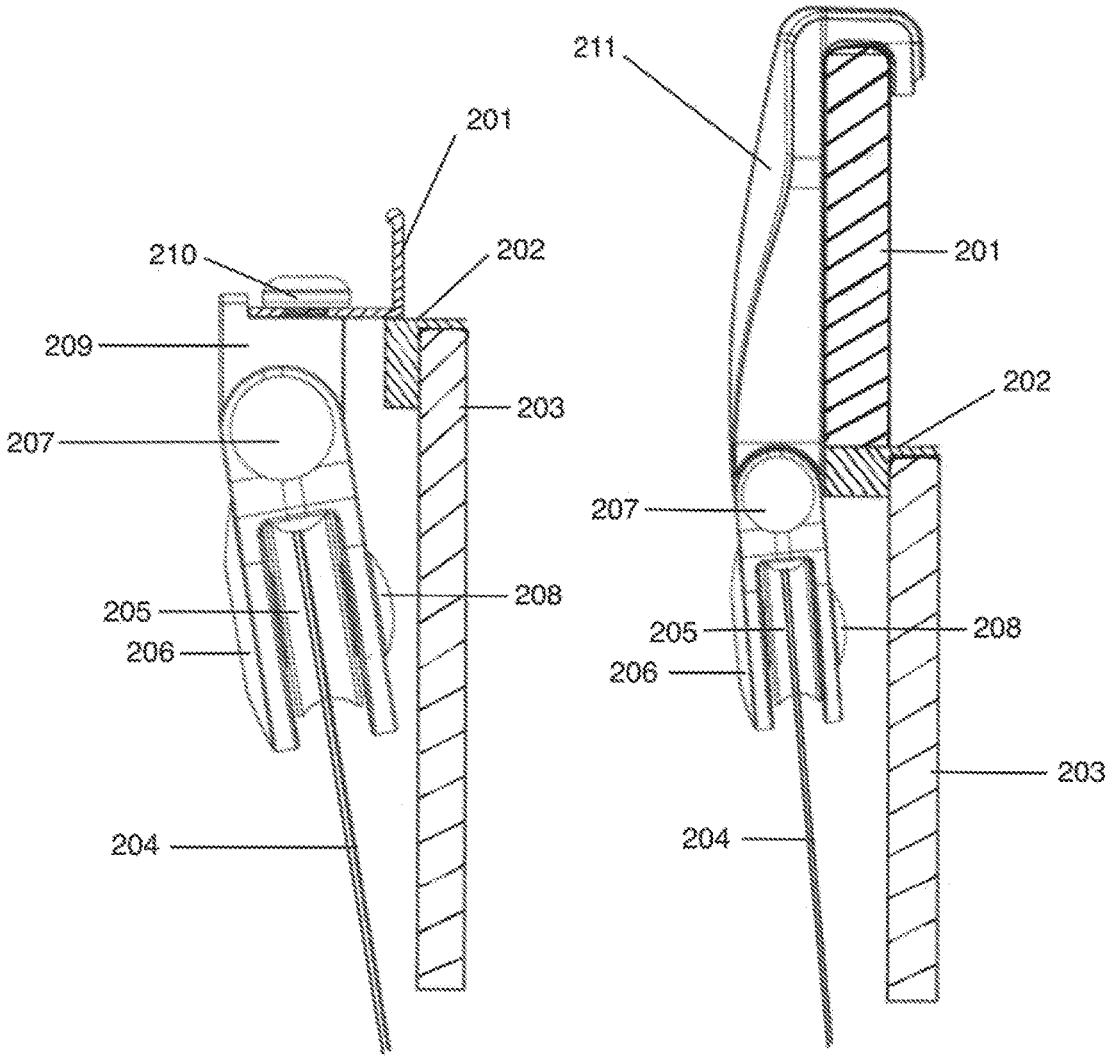
FIG. 2 shows side views of the adjustable-angle pulley assembly, mounted to hoops with protruding flanges for the bolt-on version (FIG. 2A), and the claw version for annular hoops (FIG. 2B), and the relation of the pulley angle to the natural path of the cable as it traverses the circumference of the shell.

Within the invention there are two types of angled pulley (pulleys, guides or grommets 205) assemblies 106: fixed-angle (FIG. 9) and adjustable-angle (FIG. 1-5, 7, 8). A fixed angle pulley assembly (FIG. 9) is non-adjustable, in which the angle of the pulley housing 901 is fixed in direct relation to the natural angle of the cable (FIG. 1,2, 10) on that specific diameter and depth of shell 103. A fixed-angle pulley assembly can be a bolt-on fixture (FIG. 9) utilizing a ridge 902 or boss 903 to keep the fixture from rotating from its desired place on the hoop 102, or built into a claw fixture 402, or built into the hoop 102. An adjustable-angle pulley assembly (FIG. 1-5, 7, 8) can be a bolt-on fixture (FIG. 2A) also employing a ridge 216 or boss 903 to keep the fixture from rotating from its desired place on the hoop 102, or a claw fixture (FIG. 2B) employing a contact surface 512 where the use of velcro, tape, set screw, or any other form of attachment so that when there is no cable tension, the claw 501 stays in its' respective place on the hoop 401 and does not detach unintentionally. Both configurations consist of a pulley housing 206 either machined or cast (FIG. 2-5, 7) or bent or stamped sheet metal (FIG. 8) which is attached by one or more axles or rotation points 207 to a separate fixture 209/211 which attaches to the hoop 201. The adjustable-angle pulley assembly (FIG. 1-5, 7, 8) has the ability to adjust to different angles for different sized drums. An adjustable-angle pulley assembly can be free floating to adjust the angle itself under cable tension (FIG. 2-5, 8), or manually adjustable (FIG. 7) wherein an adjustment bolt 706 threaded into a piece 705 which lies within the bolt-on fixture 702 received by the pulley housing 701. When the bolt 706 is turned it pulls or pushes the top of the pulley housing 701 which is rotating on an axle 704 thus adjusting the angle of which the pulley housing 701 is in relation to the bolt-on fixture 702. The angle degree can be read by markings on the bolt-on fixture 708 and markings on the pulley housing 707.

The use of non-perpendicular fixed-angle (FIG. 9) or adjustable-angle pulley assemblies (FIG. 1-5, 7, 8) allows the pulley 205 to follow the angle at which the cable 104 is laced between the top and bottom hoops 102 while traversing the circumference of the drum shell 103. Because the cable 104 is traversing the circumference of the drum shell 103 (FIG. 1), the angle of the cable 104 will never be directly parallel to the top-bottom axis of the shell 103 itself. The angle of the cable 104 varies depending on the number of pulley assemblies 106, and the diameter and depth of the shell 103. Therefore, the use of an angled pulley housing assembly is creating an environment of least friction and wear because it is allowing the pulley 205 to follow the cable's natural angle of least resistance 204, which angle also distributes the load from the cable tension evenly on the pulley 205 and its axle 207, rather than skewing the load to the outer edges of the pulley 205 and the axle 207. The adjustable-angle pulley assembly (FIG. 2) is enhanced by incorporating a control stop 314 which keeps the assembly from angling too far and making contact with the shell itself 103. See FIG. 3 314 (bolt-on assembly) and FIG. 5 506 (claw assembly).

Figure 6:
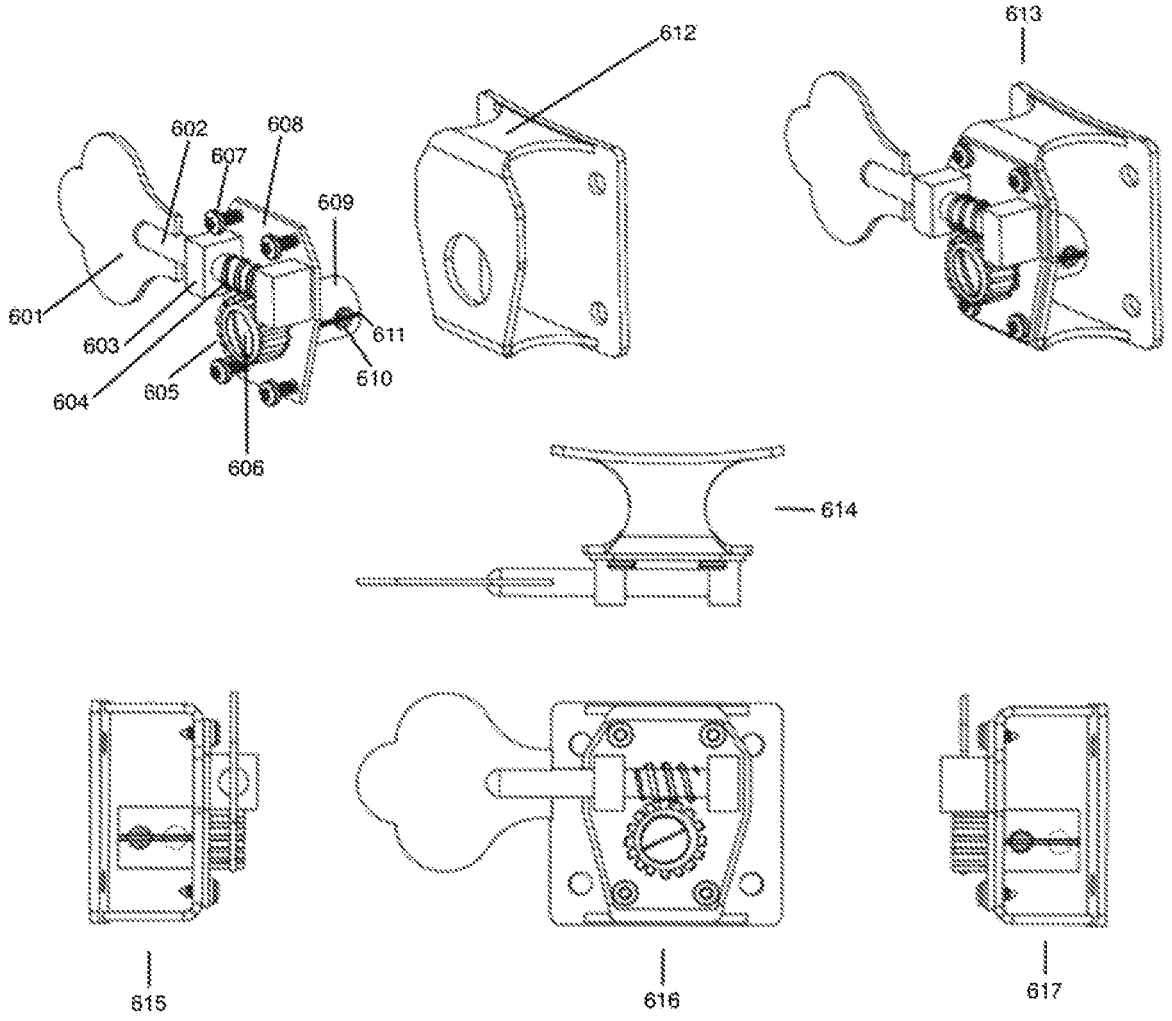
FIG. 6 shows detailed views of a possible tensioning mechanism and mounting bracket.
Figure 17:
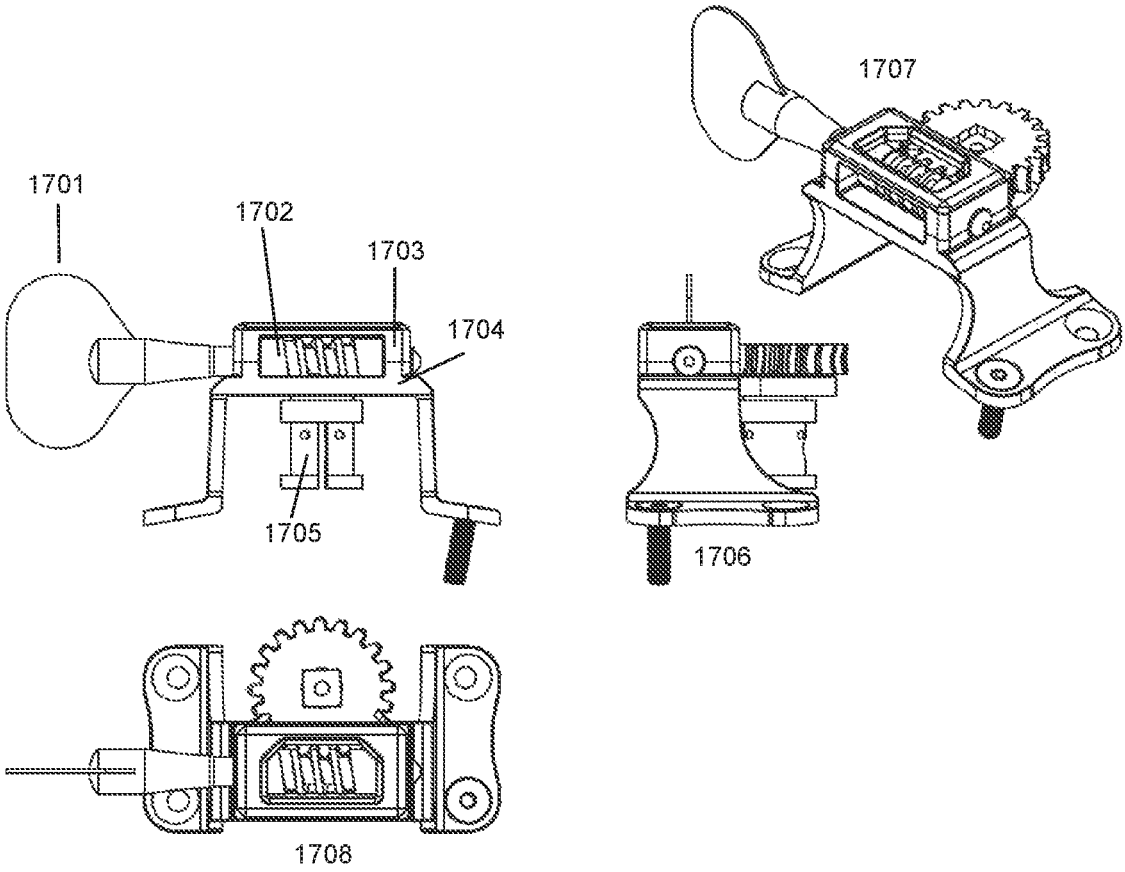
FIG. 17 shows a tensioning mechanism mounting bracket with integrated worm gear mechanism.

In order to tighten or loosen the cable tension, a tensioning mechanism, most obvious but not limited to; a reduction gear tensioning mechanism; exemplified as a planetary gear (FIG. 11) or worm gear (FIG. 6) can be built into the hoop 102, or attached to the shell 103 by a mounting bracket 612. The use of a planetary gear may or may not employ the need for a drive gear. In FIG. 6 the tensioning mechanism components 601-606 are attached to a mounting plate 608 by means of brackets 603 which hold the adjustment handle assembly 601/602/604 and a bolt 606 attaching the gear 605. The mounting plate 608 is bolted 607 onto the mounting bracket 612. The tensioning mechanism components 601-606 can also be built into the mounting bracket 612 itself to eliminate the need for a mounting plate 608, as described in FIG. 17. The cable 104 is threaded through a plurality of angled pulley assemblies 106, with one or both ends of the cable 104 passing through a slot 611 in the winding post 609, employing a receptacle 610 for one or both ends of the cable. When the adjustment handle 601 is turned, the axle 602 rotates, turning the threading 604 which correlates to the gear 605 which is bolted 606 to the winding post 609 thus spooling the cable 104. In FIG. 17, the worm gear or planetary gear components are integrated into the mounting bracket, eliminating the need for a mounting plate as described in FIG. 6/608. The drive gear with handle is supported by the top bracket 1703 which is bolted to the body 1704, thus trapping the drive gear 1702 in place while still allowing it to turn freely. The winding post 1705, which employs a slot for the cable to pass through 1806, a receptacle for ball or crimped end 1804, and 2 holes 1805 for a non-crimped end of the cable to pass through and cinch. the winding post passes through the mounting bracket and is attached to the main gear by a threaded hole in the top 1802 and a profile 1803 keeping the main gear from spinning freely from the winding post. The gearing reduction and frictional forces within the tensioning mechanism (FIG. 6, 11) allow for infinite non-incremental tuning control for both increasing and decreasing cable 104 and head 101 tension, as well as a separation of force between the winding post 609 and the point of adjustment 601. This mechanism (FIG. 6, 11) adjusts tension on the cable 104 smoothly and precisely in the direction of increasing and decreasing tension. The use of a reduction gear; planetary gear (FIG. 11) or worm gear (FIG. 6) reduces the amount of torque input or effort needed from the hand operated adjustment point 601, which allows the user to reach very high cable tension with little effort. This permits rapid and relatively effortless re-tuning of a drum that requires little force or user strength. The reduction mechanism (FIG. 6, 11) is free from ratcheting or pawl stops so that it can be tuned very precisely both directions, increasing or decreasing tension. The use of reduction gearing; worm gear (FIG. 6) or planetary gear tensioning mechanism (FIG. 11) also provides silent tuning which does not have an audible click that a ratchet or similar mechanism would have. There are many advantages to using a silent tensioning mechanism. Because there is no audible click, this allows the user to hear only the tone of the resonating drum while adjusting tension, which allows for the desired pitch to be recognized easier, as well as expanding the utility of the drum itself by allowing the pitch to be easily changed while playing the drum. A planetary gear (FIG. 11) or worm gear (FIG. 6) tensioning mechanism can be further enhanced by incorporating a 'drop-down' or 'detuner' tuning mechanism (FIG. 12), which allows for a quick drop or increase of tension. This allows for multiple predetermined tension settings to be easily reached on the fly.

The utility of the invention can be enhanced (FIG. 14) by including an in-line tension gauge 1407 separate from the tensioning mechanism 1405, which facilitates accurate tuning so a specific desired pitch by bringing the cable 1404 to a pre-determined tension. The tension gauge can be built into a custom hoop 1402, integrated into the tensioning mechanism assembly 1405, free floating, or mounted to the shell 1403 (shown). Since drumhead pitch is a function of cable 1404 and head 1401 tension, the system allows accurate re-tuning even as the cable 1404 and head 1401 age and stretch, and even in noisy venues where re-tuning by listening to pitch may be impractical or where atmospheric variations make frequent re-tuning necessary.

FIG. 1 shows a side view (FIG. 1A) and overhead view (FIG. 1B) of the present invention.

101 is the tunable vibrating membrane.

102 is the hoop with protruding flanges.

103 is the shell.

104 is the cable.

105 is the tensioning mechanism.

106 is the adjustable-angle pulley assembly.

FIG. 2 shows the application of the bolt-on adjustable-angle pulley assembly for hoops with protruding flanges (FIG. 2A), the claw version of the adjustable-angle pulley assembly for annular hoops (FIG. 2B), and the relation of the natural angle of the cable in relation to the pulley itself as it is traversing the circumference of the shell.

201 is the hoop.

202 is the head.

203 is the shell.

204 is the cable.

205 is the pulley.

206 is the pulley housing.

207 is the axle which attaches the pulley housing to the bolt-on fixture.

208 is the axle which holds the pulley in place within the pulley housing.

209 is the bolt-on fixture which is bolted to the hoop with protruding flanges and the pulley housing.

210 is the bolt which attaches the hoop to the bolt-on fixture.

211 is the claw which takes the place of the bolt-on fixture for annular hoops.

FIG. 3 shows different views of the adjustable-angle pulley assembly, including an exploded view (FIG. 3A) and dissected view (FIG. 3B).

301 is the bolt which attaches the bolt-on fixture to a hoop with protruding flanges.

302 is the axle which attaches the pulley housing to the bolt-on fixture, and allows the pulley housing angle to self-adjust.

303 is the axle which attaches the pulley to the pulley housing.

304 is the bolt-on fixture which connects to the pulley housing and the hoop with protruding flanges.

305 is the pulley.

306 is the pulley housing.

307 is an angled view of the bolt-on adjustable-angle pulley assembly.

308 is an angled view of the bolt-on adjustable-angle pulley assembly.

309 is a front facing view of the bolt-on adjustable-angle pulley assembly.

310 is a side view of the bolt-on adjustable-angle pulley assembly.

311 is a rear view of the bolt-on adjustable-angle pulley assembly.

312 is the hoop with protruding flanges.

313 is the drum head rim.

314 is the contact point of the control stop which keeps the pulley assembly from angling too far and making contact with the shell.

315 is the shell.

316 is the ridge to keep the fixture from rotating from its desired placement on the hoop.

Figure 4:
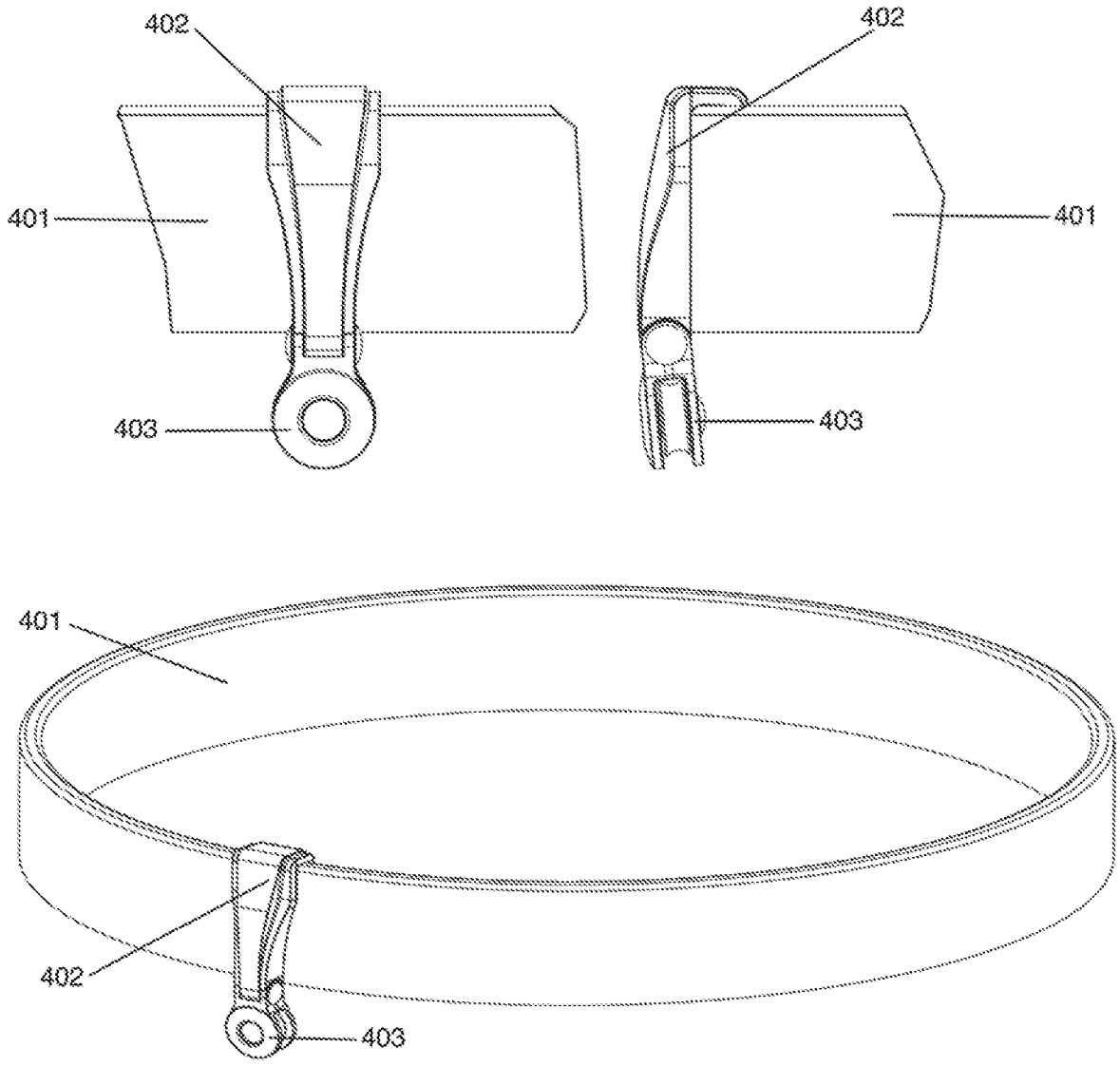
FIG. 4 shows detailed views of the annular hoop claw version of the adjustable-angle pulley assembly.

FIG. 4 shows the claw version of the adjustable-angle pulley assembly applied to an annular hoop.

401 is the hoop.

402 is the claw fixture.

403 is the pulley housing.

Figure 5:
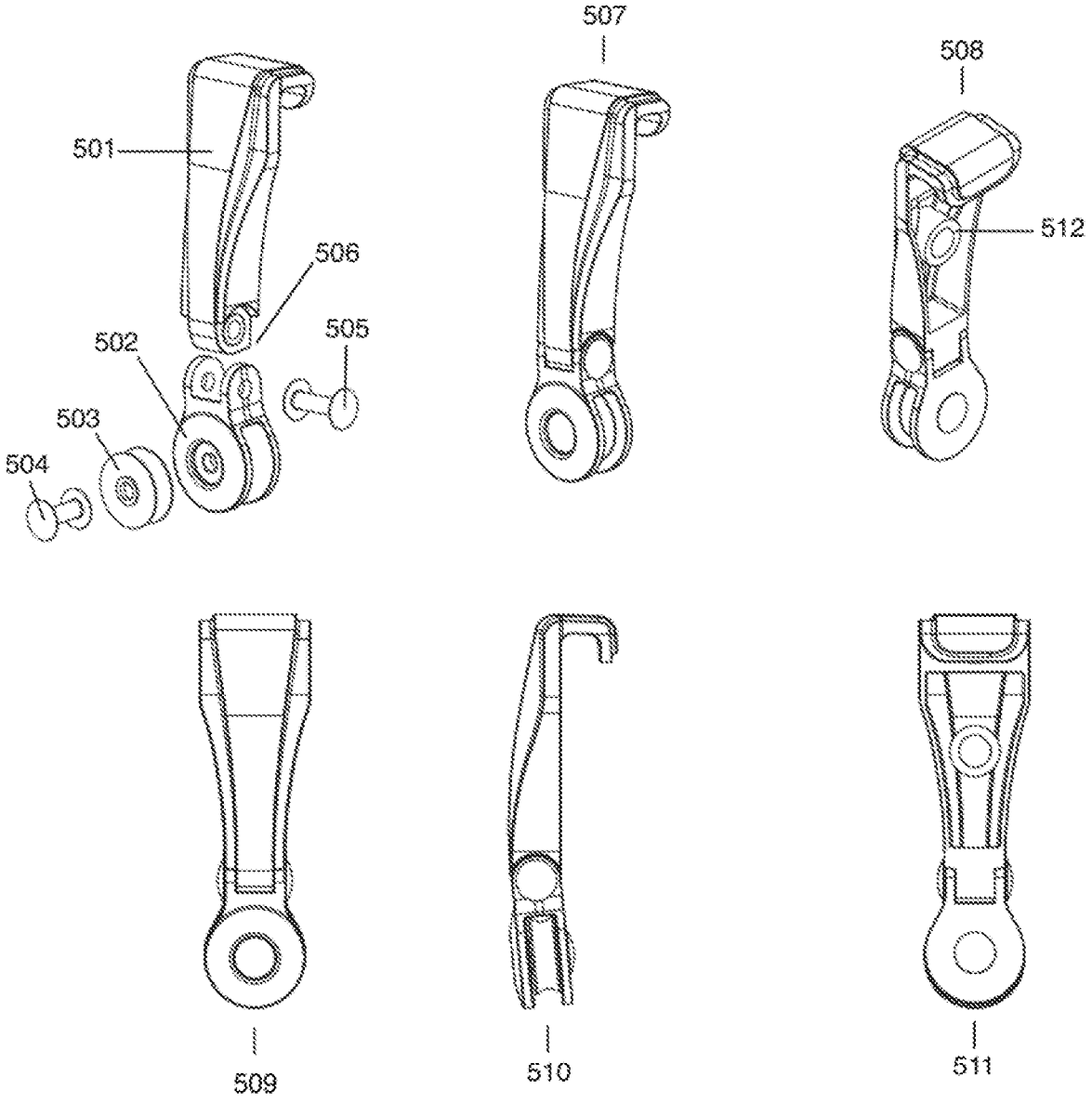
FIG. 5 shows more detailed views of the claw version of the adjustable-angle pulley assembly.

FIG. 5 shows different views of the claw version of the adjustable-angle pulley assembly, including an exploded view.

501 is the claw fixture.

502 is the pulley housing.

503 is the pulley.

504 is the axle which attaches the pulley to the pulley housing.

505 is the axle which attaches the pulley housing to the claw fixture.

506 is the control stop which keeps the pulley housing from angling too far and making contact with the shell.

507 is an angled view of the claw version of the adjustable-angle pulley assembly.

508 is an angled view of the claw version of the adjustable-angle pulley assembly.

509 is a front facing view of the claw version of the adjustable-angle pulley assembly.

510 is a side view of the claw version of the adjustable-angle pulley assembly.

511 is a rear view of the claw version of the adjustable-angle pulley assembly.

512 is a contact surface where the use of velcro, tape, set screw, or any other form of attachment so that when there is no cable tension, the claw stays in its' respective place on the hoop and does not detach unintentionally.

FIG. 6 shows detailed views of the tensioning mechanism and mounting bracket.

601 is the adjustment handle.

602 is the center axle of the worm gear adjustment.

603 is the bracket which keeps the adjustment handle in place.

604 is the threading which is part of the worm gear adjustment axle.

605 is the gear which is bolted through the mounting plate into the winding post.

606 is the bolt which attaches the gear to the winding post.

607 is the bolt which attaches the worm gear mounting plate to the mounting bracket.

608 is the worm gear mounting plate.

609 is the winding post.

610 is the receptacle which receives the ball or crimped end of the cable.

611 is the slot in the winding post which allows the cable to pass all the way through.

612 is the mounting bracket which connects the worm gear mounting plate to the shell.

613 is an angled view of the assembled worm gear tensioning mechanism.

614 is an overhead view of the assembled worm gear tensioning mechanism.

615 is a side view of the assembled worm gear tensioning mechanism.

616 is a front facing view of the assembled worm gear tensioning mechanism.

617 is a side view of the assembled worm gear tensioning mechanism.

Figure 7:
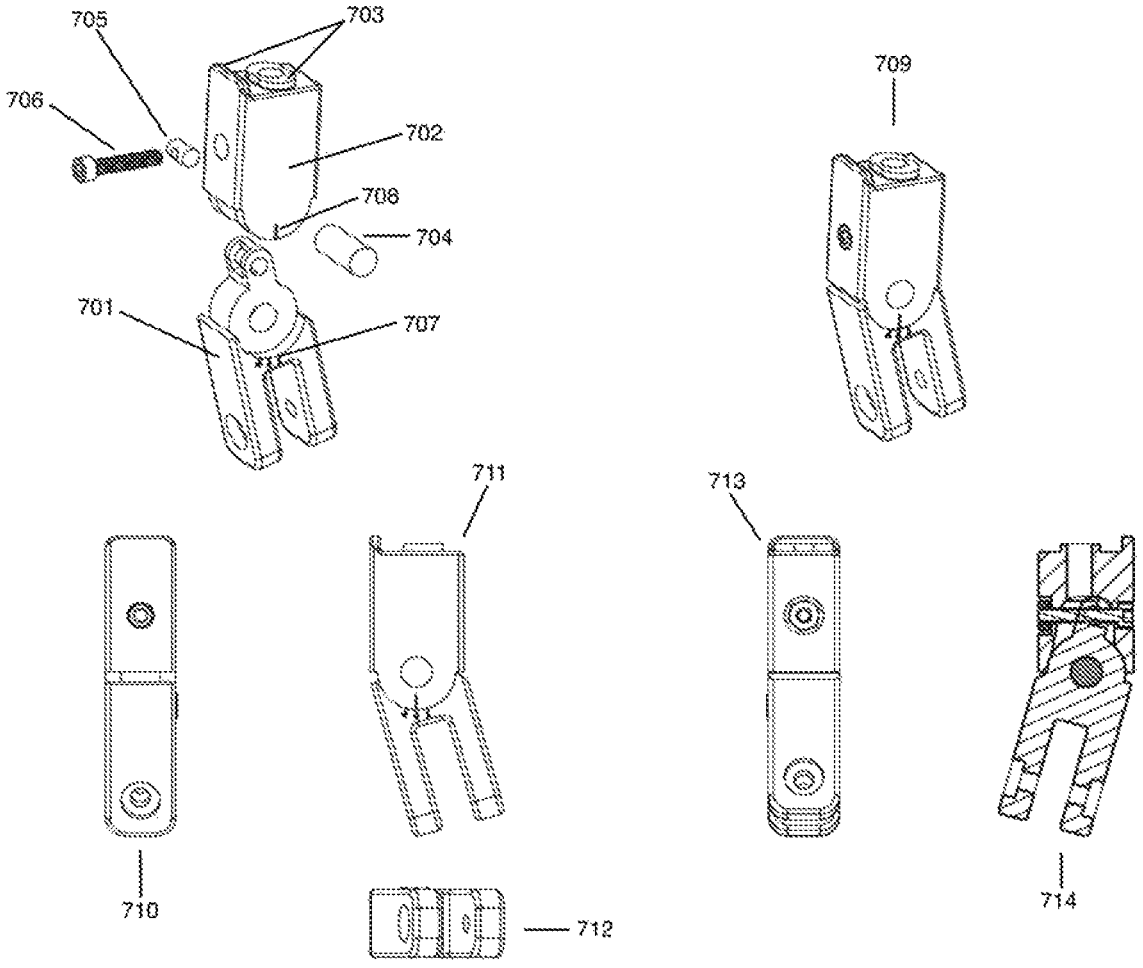
FIG. 7 shows views of an adjustable-angle pulley assembly that can be manually set to a specific degree of angle.

FIG. 7 shows detailed views of a bolt-on adjustable-angle pulley assembly with manual angle adjustment.

701 is the pulley housing.

702 is the bolt-on fixture.

703 is the guide, ridge or boss to center the fixture in the hole or slot of the hoop and keep the fixture from rotating from its desired placement on the hoop.

704 is the axle which attaches the pulley housing to the bolt-on fixture.

705 is a threaded piece which is received by a cutout in the bolt on fixture which allows the pulley housing angle to be adjusted when the bolt (706) is turned.

706 is the angle adjustment bolt.

707 is a marking of the angle in degrees.

708 is a marking on the bolt-on fixture which corresponds to markings on the pulley housing.

709 is an angled view of the bolt-on adjustable-angle pulley assembly with manual angle adjustment.

710 is a front facing view of the bolt-on adjustable-angle pulley assembly with manual angle adjustment.

711 is a side view of the bolt-on adjustable-angle pulley assembly with manual angle adjustment.

712 is a bottom view of the bolt-on adjustable-angle pulley assembly with manual angle adjustment.

713 is a rear view of the bolt-on adjustable-angle pulley assembly with manual angle adjustment.

714 is a section view of the bolt-on adjustable-angle pulley assembly with manual angle adjustment.

Figure 8:
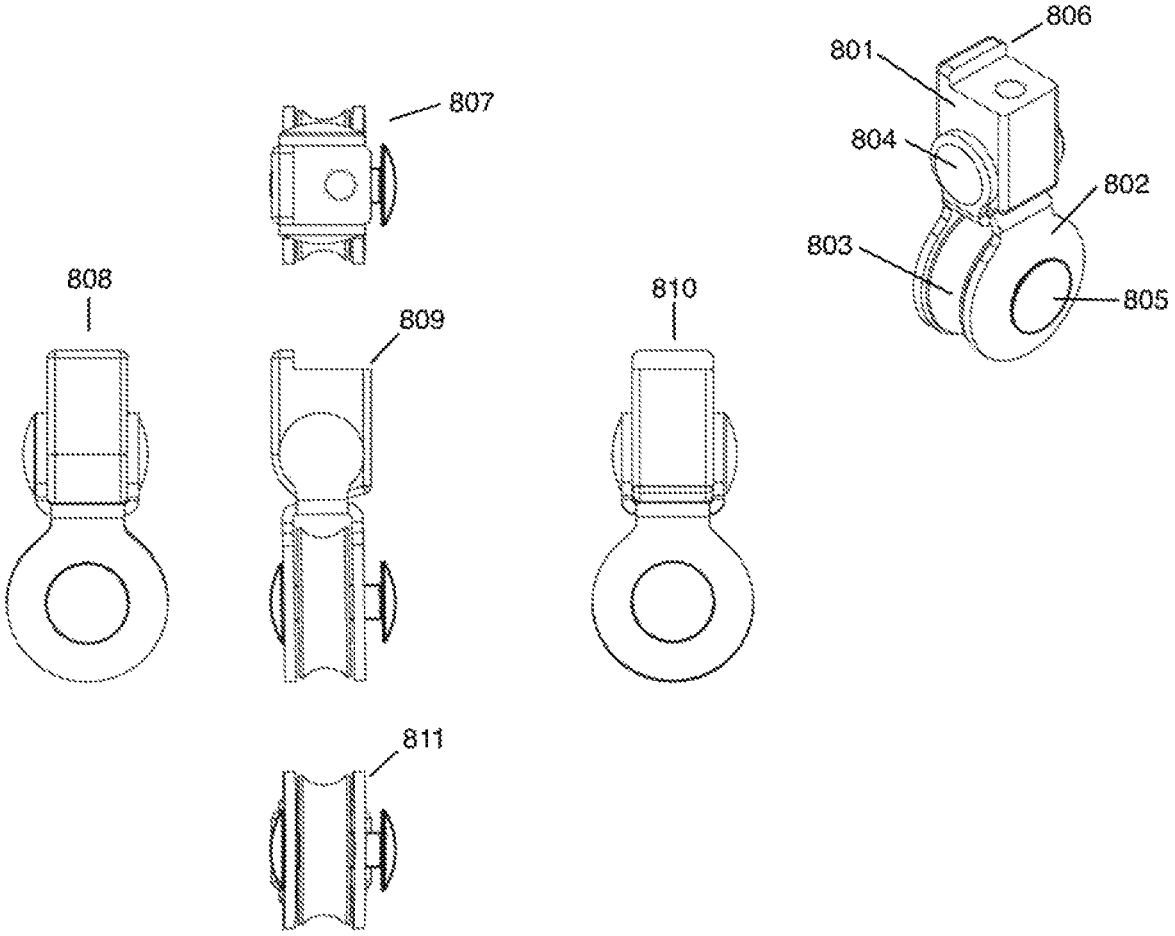
FIG. 8 shows views of a sheet metal version of the adjustable-angle pulley assembly.

FIG. 8 shows a version of the bolt-on adjustable-angle pulley assembly using a sheet metal version of the pulley housing.

801 is the bolt-on fixture as described in FIG. 2-209.

802 is the folded sheet metal pulley housing.

803 is the pulley.

804 is the axle which attaches the pulley housing to the bolt-on fixture.

805 is the axle which attaches the pulley to the pulley housing.

806 is the ridge which guides the pulley assembly to center the fixture in the hole or slot of the hoop and/or keep the fixture from rotating from its desired placement on the hoop as described in FIG. 7 (706).

807 is an overhead view of the adjustable-angle pulley assembly using a sheet metal version of the pulley housing.

808 is a front facing view of the adjustable-angle pulley assembly using a sheet metal version of the pulley housing.

809 is a side view of the adjustable-angle pulley assembly using a sheet metal version of the pulley housing.

810 is a rear view of the adjustable-angle pulley assembly using a sheet metal version of the pulley housing.

811 is a bottom view of the adjustable-angle pulley assembly using a sheet metal version of the pulley housing.

Figure 9:
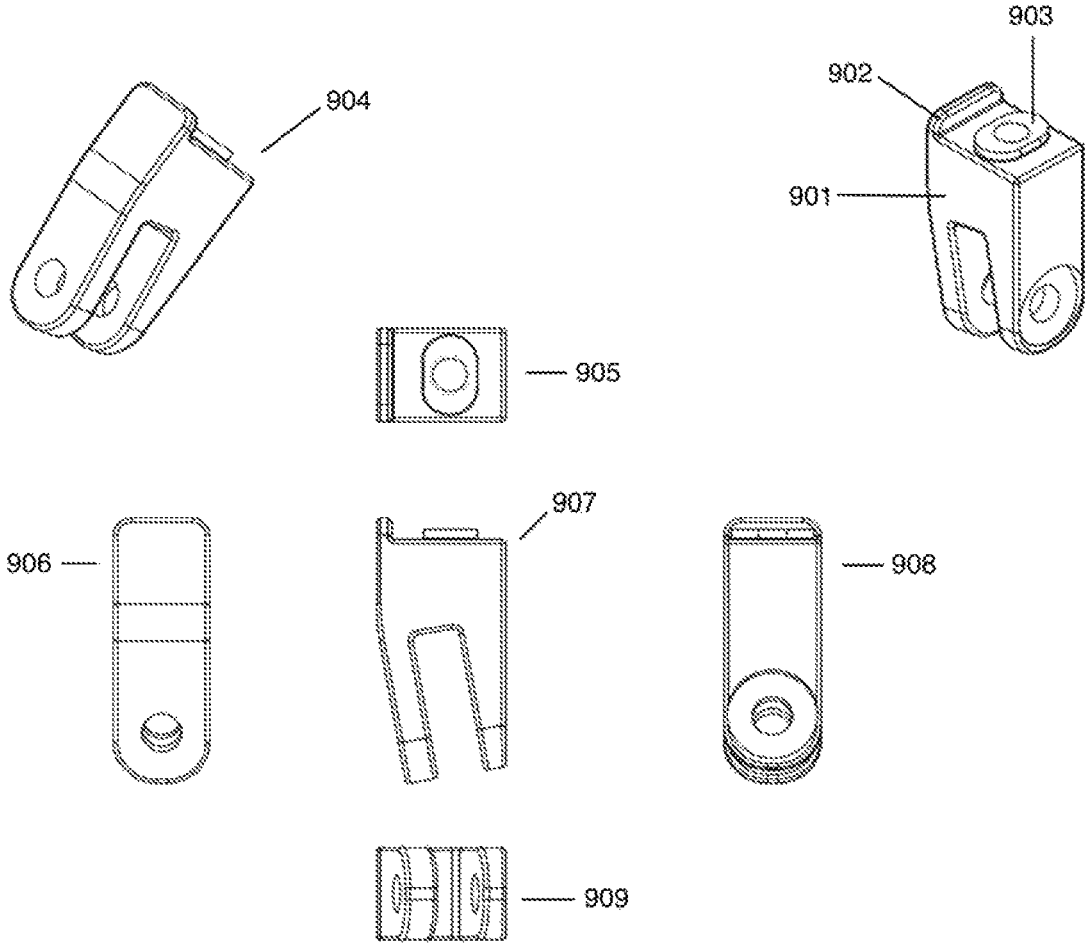
FIG. 9 shows views of a fixed-angle pulley assembly which directly correlates to the angle of the cable depending on the size of the corresponding shell.

FIG. 9 shows detailed views of a fixed-angle bolt-on pulley assembly in which the angle of the pulley is in direct relation to the natural path of the cable as it is traveling the circumference of the shell.

901 is the pulley housing.

902 is the ridge to keep the fixture from rotating from its desired placement on the hoop.

903 is the boss to center the fixture in the hole or slot of the hoop and point where the fixture is bolted to the hoop.

904 is an angled view of the fixed-angle pulley assembly.

905 is an overhead view of the fixed-angle pulley assembly.

906 is a front facing view of the fixed-angle pulley assembly.

907 is a side view of the fixed-angle pulley assembly.

908 is a rear view of the fixed-angle pulley assembly.

909 is a bottom view of the fixed-angle pulley assembly.

Figure 10:
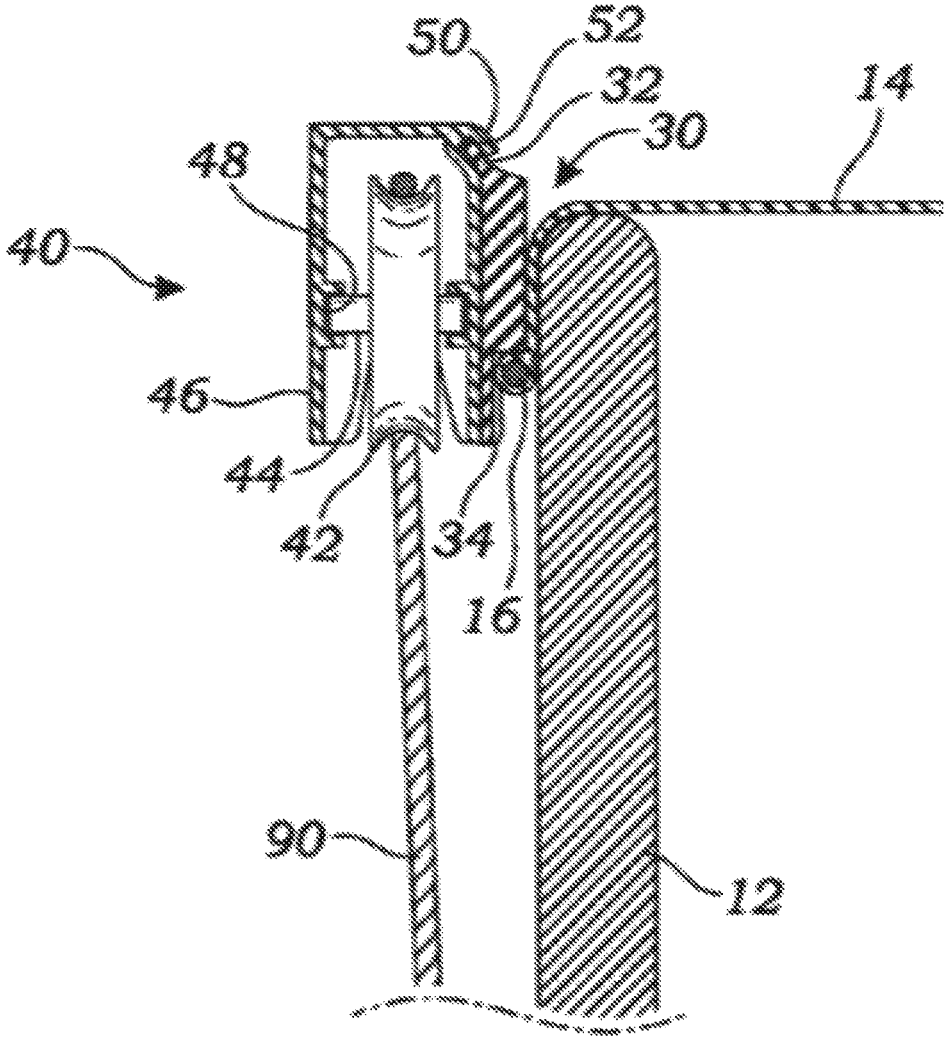
FIG. 10 shows prior art from U.S. Pat. No. 9,006,548 (Bedson FIG. 4), which illustrates that the cable is entering and exiting the pulley at a different angle than the pulley itself when the pulley is fixed parallel to the shell.

FIG. 10 shows prior art from U.S. Pat. No. 9,006,548 (Bedson FIG. 4), which illustrates that the cable is entering and exiting the pulley at a different angle than the pulley itself when the pulley is fixed parallel to the shell.

Figure 11:
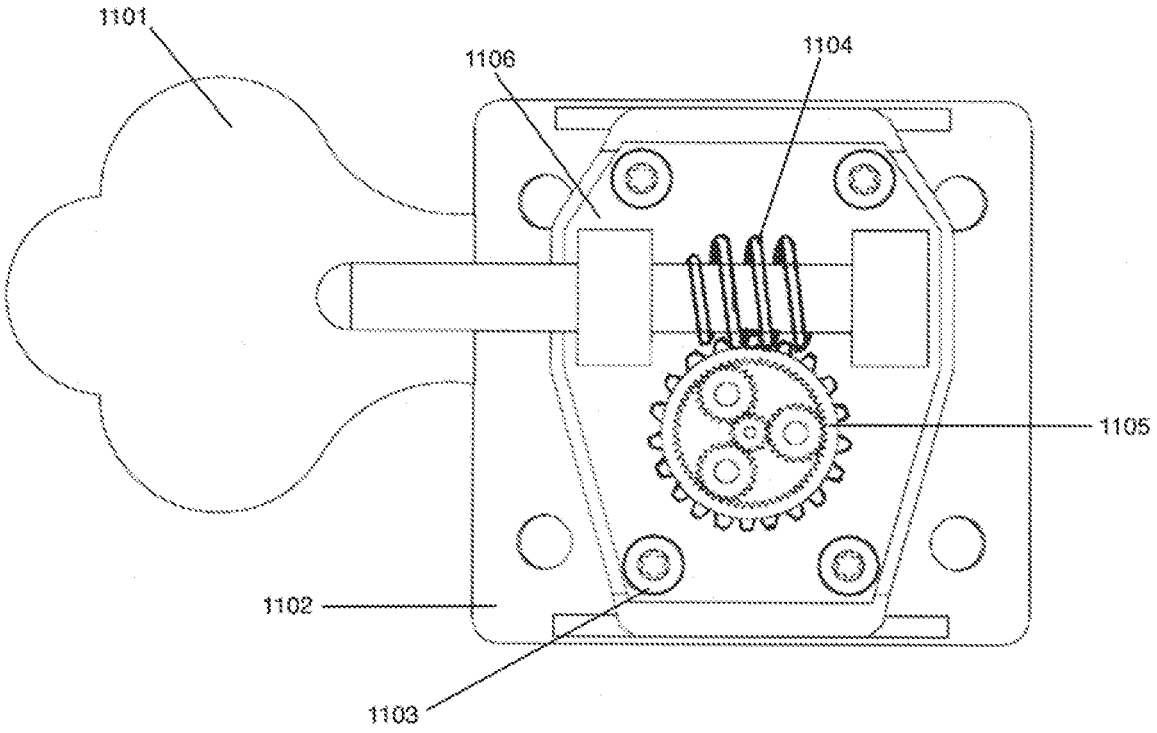
FIG. 11 shows a planetary gear tensioning mechanism.

FIG. 11 shows a planetary gear tensioning mechanism.

1101 is the adjustment handle.

1102 is the mounting bracket.

1103 is the bolt attaching the mounting plate to the mounting bracket.

1104 is the threading which correlates to the planetary gear.

1105 is the planetary gear.

1106 is the planetary gear mounting plate.

Figure 12:
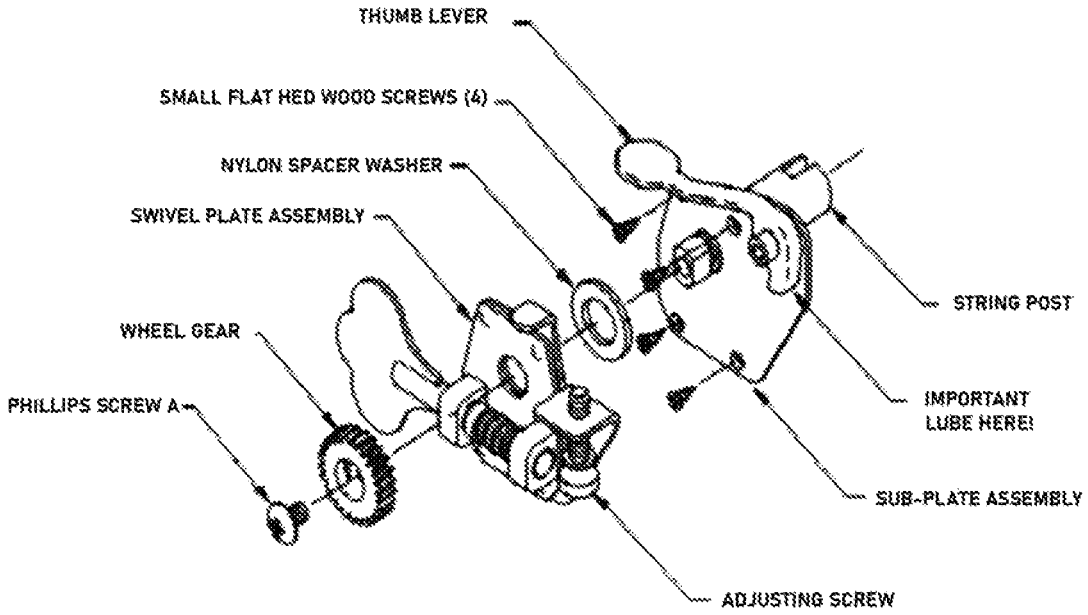
FIG. 12 shows prior art of one embodiment of a drop-down detuner tensioning mechanism.

FIG. 12 shows prior art illustrating the components of a drop-down detuner tensioning mechanism.

Figure 13:
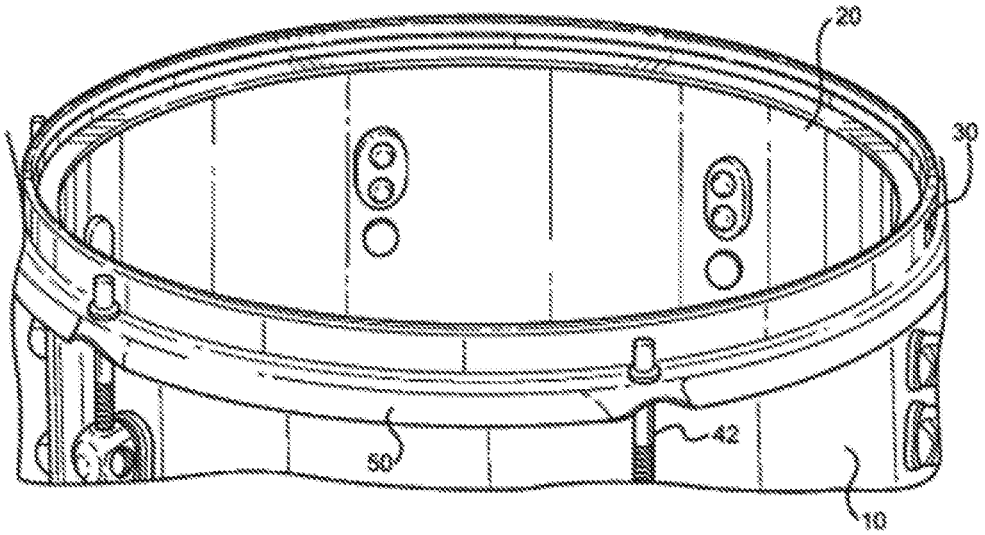
Fig. 13 Prior Art
FIG. 13 shows prior art of a standard tension rod and bracket tensioning system.
Figure 13:
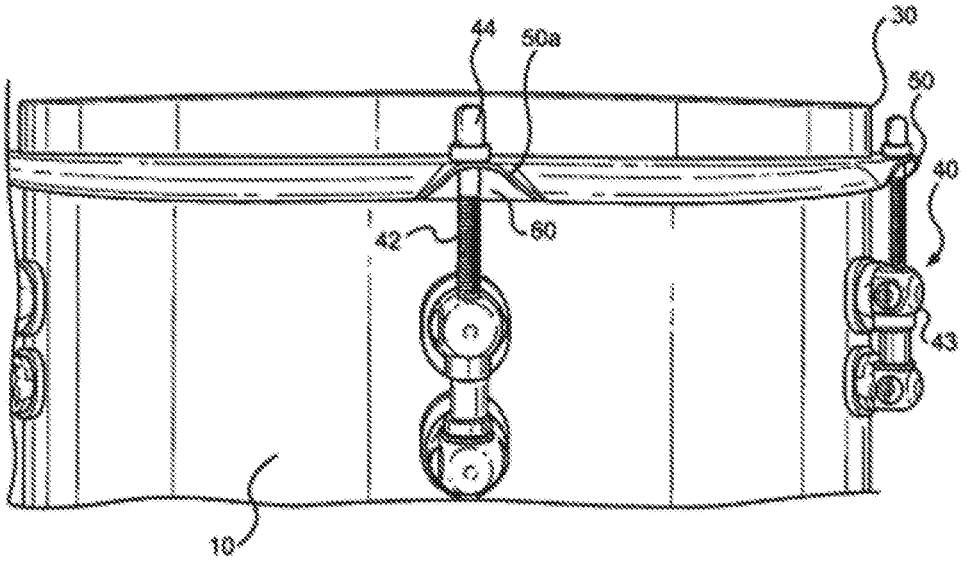
Fig. 13 Prior Art

FIG. 13 shows prior art illustrating the standard tension rod and bracket tensioning system.

Figure 14:
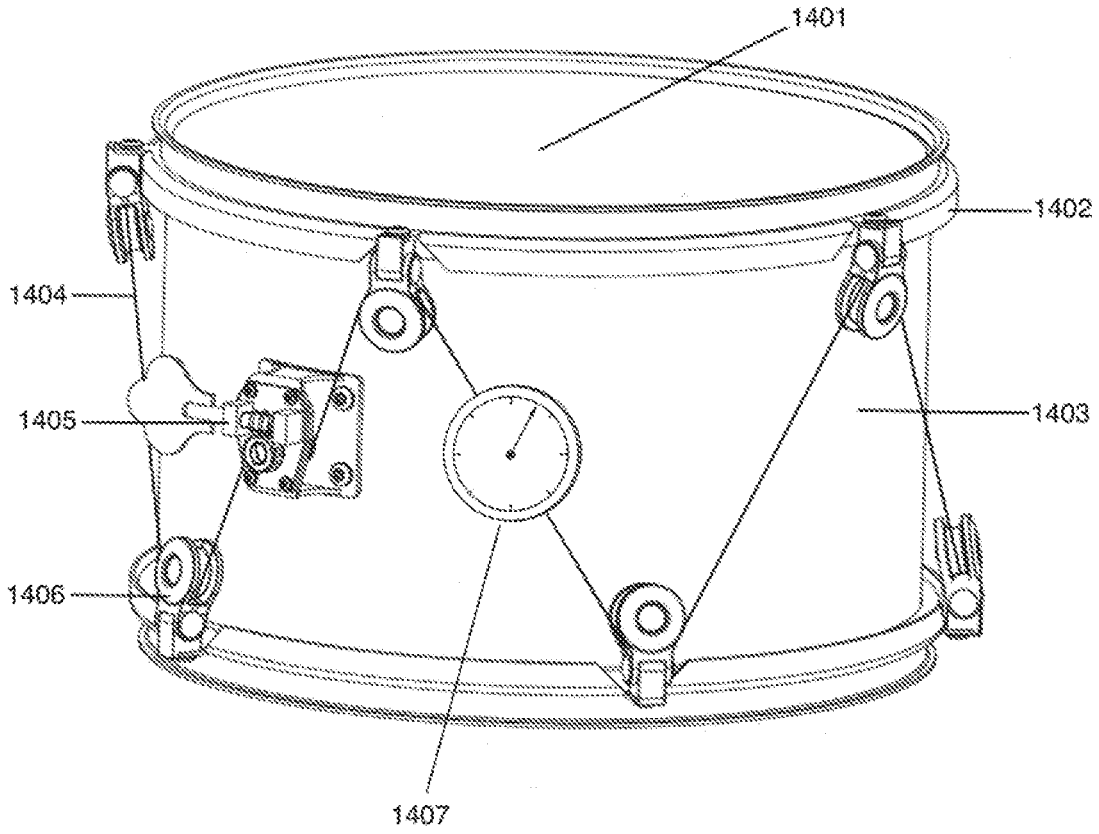
FIG. 14 shows the incorporation of a tension or strain gauge mounted to the shell.

FIG. 14 shows one possible configuration of a separate strain or tension gauge which measures how much tension is on the cable and therefore the head tension.

1401 is the head.

1402 is the hoop.

1403 is the shell.

1404 is the cable.

1405 is the tensioning mechanism.

1406 is the angled pulley assembly.

1407 is the strain or tension gauge.

Figure 15:
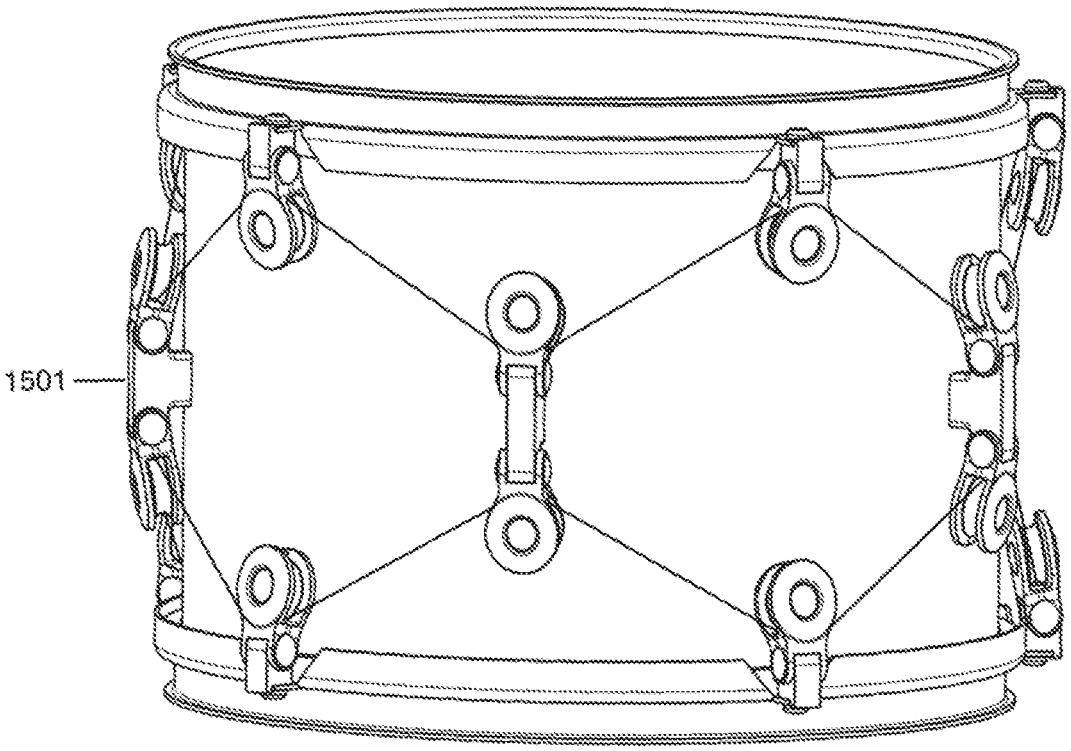
FIG. 15 shows a configuration of the system applied to independently tunable top and bottom heads.

FIG. 15 shows a configuration of the system applied to independently tunable top and bottom vibrating membranes by incorporating a bracket attached to the shell which accepts an angled pulley assembly.

1501 is the bracket which accepts an angled pulley assembly.

Figure 16:
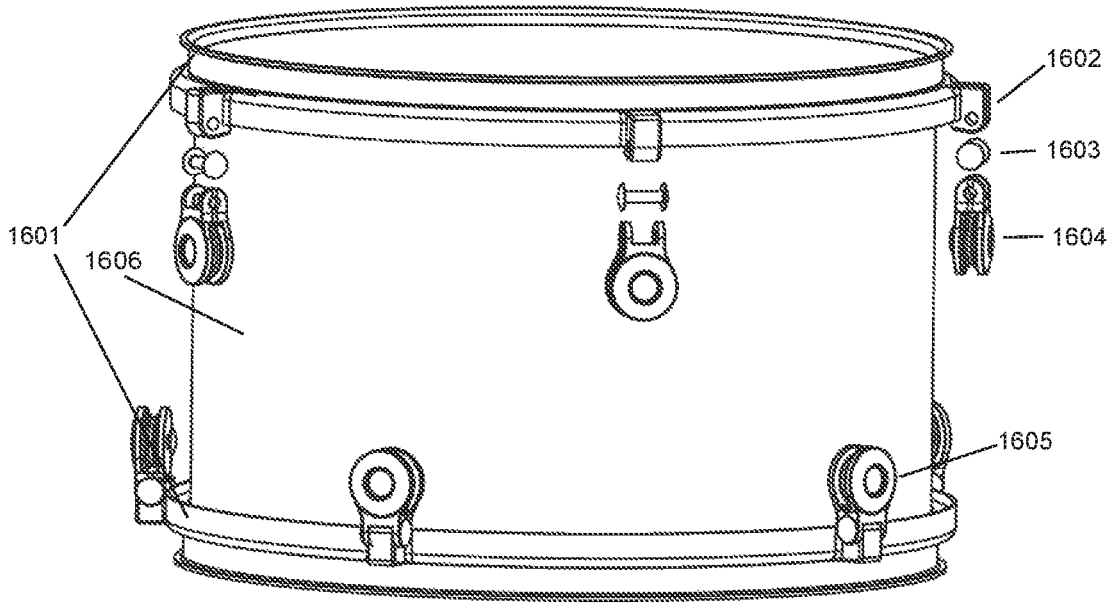
FIG. 16 shows a configuration of angled pulley assemblies integrated into hoops.

FIG. 16 shows a possible configuration where the angled pulley assembly is integrated into the hoop.

1601 is the hoop.

1602 is the bolt on fixture which is now integrated into the hoop which is the attachment point for the pulley housing.

1603 is the axle which attaches the pulley to the pulley housing.

1604 is the pulley housing.

1605 is the assembled pulley assembly on the integrated hoop.

1606 is the shell.

FIG. 17 shows a mounting bracket assembly which integrates worm gear or planetary gear components, eliminating the need for a mounting plate.

1701 is the handle.

1702 is the drive gear connected to the handle.

1703 is the top bracket.

1704 is the bottom bracket/body.

1705 is the winding post.

1706 is a side view of the mounting bracket assembly.

1707 is a perspective view of the mounting bracket assembly.

1708 is an overhead view of the mounting bracket assembly.

Figure 18:
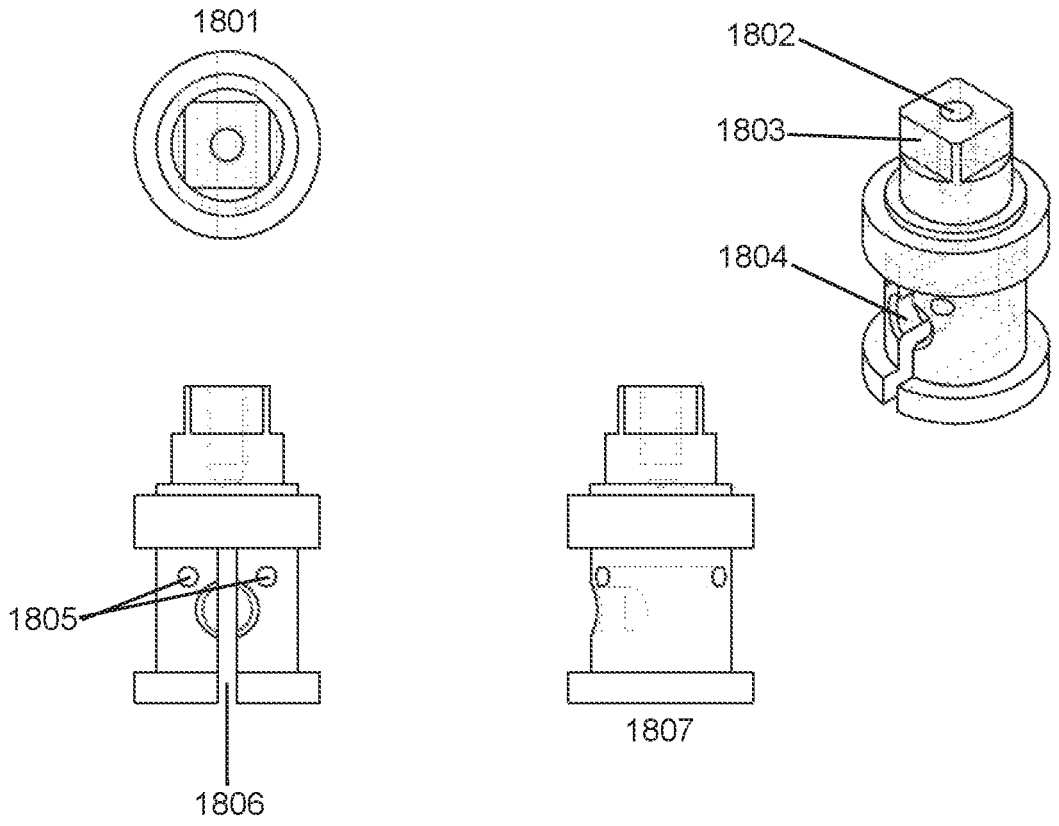
FIG. 18 shows a winding post.

FIG. 18 is a winding post.

1801 is an overhead view of the winding post.

1802 is the threaded hole to attach the gear.

1803 is a profile cast or machined to fit into a corresponding slot in the gear.

1804 is a receptacle to accept a ball or crimped end of the cable.

1805 are holes to allow a non-crimped end of cable to pass through and cinch.

1806 is a slot which passes all the way through the winding post.

1807 is a side view of the winding post.

Figure 19:
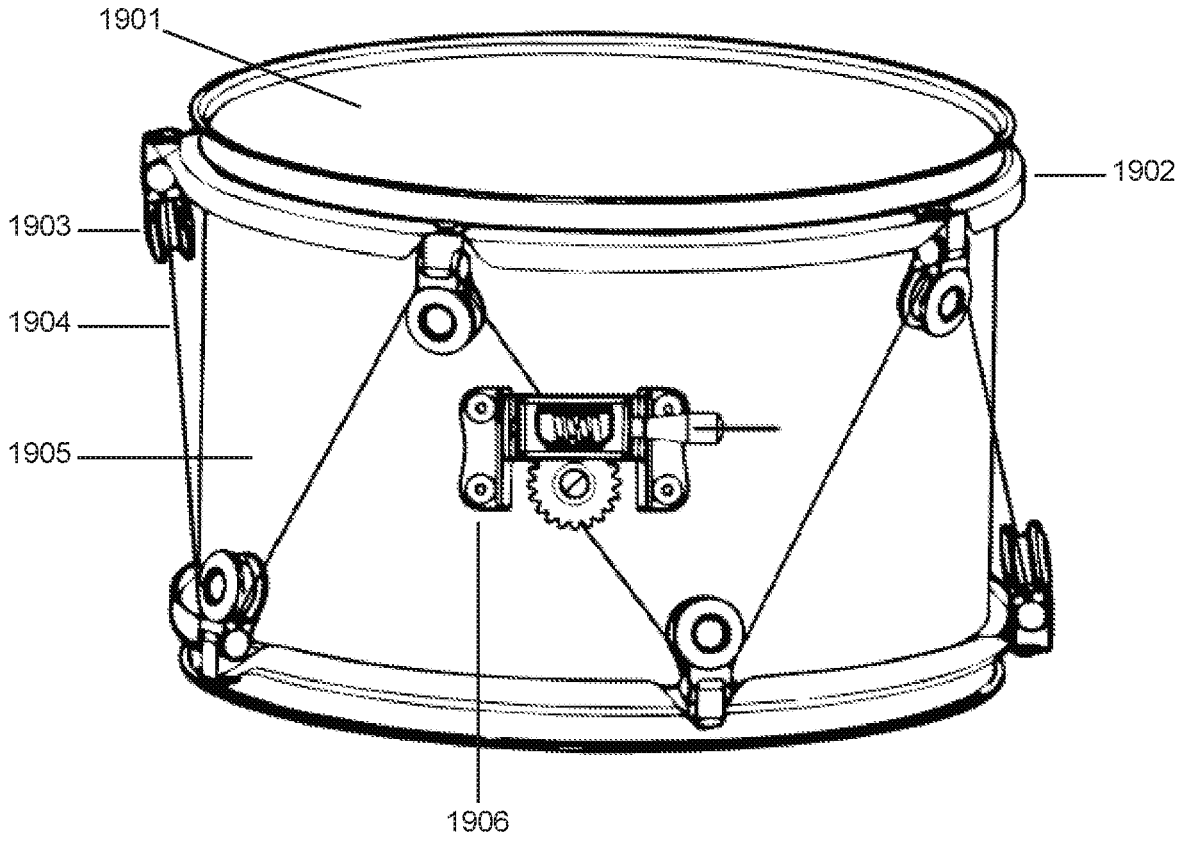
FIG. 19 shows a side view of the invention with the adjustable-angle pulleys shown in FIG. 3 and the tensioning mechanism mounting bracket shown in FIG. 17.

FIG. 19 shows a side view of the invention with the adjustable-angle pulleys shown in FIG. 3 and the tensioning mechanism mounting bracket shown in FIG. 17.

1901 is the tunable vibrating membrane.

1902 is the hoop.

1903 is the adjustable-angle pulley assembly as shown in FIG. 3.

1904 is the cable.

1905 is the shell.

1906 is the mounting bracket assembly as shown in FIG. 17.

The invention claimed is:

1. A tensioning system for tuning and securing a vibrating membrane on a drum shell, the tensioning system comprising:

a top hoop, the top hoop fitting the vibrating membrane on the drum shell;

a plurality of pulley assemblies adjoining each of the top hoop and either a bottom hoop or the drum shell, wherein each of the pulley assemblies further comprising:

a pulley, the pulley supported by the pulley assembly at an angle relative to the drum shell;

a cable, the cable running over the pulleys of each pulley assembly, wherein the cable is parallel to the pulley; and a tensioning mechanism to adjust tension by either tightening or loosening the cable, thereby tuning the vibrating membrane.

2. The tensioning system according to claim 1, wherein each of the pulley assemblies is either connected to or permanently attached to the top hoop and either the drum shell or the bottom hoop.

3. The tensioning system according to claim 1, wherein at least one pulley assembly is removably attached to the top hoop with a claw fixture.

4. The tensioning system according to claim 1, wherein the pulley is rotatably or pivotally attached to the top hoop.

5. The tensioning system according to claim 1, wherein the pulley assembly includes either a guide assembly or a grommet assembly.

6. The tensioning system according to claim 1, wherein the pulley assembly further comprise an angle adjusting means for limiting angular motion of the pulley relative to the drum shell.

7. The tensioning system according to claim 1, wherein the tensioning mechanism is mounted on the drum shell.

8. The tensioning system according to claim 7, wherein the tensioning mechanism further comprises:

a mounting bracket, the mounting bracket comprising:

a mounting plate attached to the drum shell via one or more bolts; and an outwardly raise portion with a hole;

tensioning components, the tensioning components comprising:

a joining plate; and a winding post protruding from the joining plate; and wherein the winding post is received in the hole of the outwardly raised portion.

9. The tensioning system according to claim 8, wherein the tensioning components further comprises:

a set of bolts to mount the mounting bracket securely on the outwardly raise portion.

10. The tensioning system according to claim 8, wherein the winding post further comprises:

a slot; and a cylindrical shaft for spooling the cable while tuning.

11. The tensioning system according to claim 10, wherein the cylindrical shaft further comprises:

one or more holes and a receptacle to cinch the cable on the cylindrical shaft.

12. The tensioning system according to claim 8, wherein the joining plate further comprises:

an adjustable handle rotationally supported by the joining plate;

a gear axle fixed to the adjustable handle;

a gear assembly interfaced with the gear axle; and a set of brackets protruding from the joining plate.

13. The tensioning system according to claim 12, wherein the adjustable handle is rotating coupled to the gear axle and supported by the set of brackets.

14. The tensioning system according to claim 12, wherein the gear assembly further comprises:

a gear and a threading portion to correlate the gear driven by rotating the adjustable handle.

15. A tension adjustment mechanism for a tensioning system for tuning one or more tunable vibrating membrane on a drum shell, the tension adjustment mechanism comprising:

a first plate attached to the drum shell;

a second plate parallel to and offset from the first plate, the second plate comprising:

a hole configured to receive a post;

a winding post positioned in the hole, wherein the winding post further comprises:

a cylindrical shaft;

a receptacle formed in the cylindrical shaft and configured for engaging a cable along the periphery of the cylindrical shaft; and a third plate connected to the second plate, the third plate comprising a gear assembly.

16. The tension adjustment mechanism according to claim 15, wherein the gear assembly comprises:

a planetary gear.

17. The tension adjustment mechanism according to claim 15, and further comprising:

an adjustable handle rotationally supported by the joining plate;

a gear axle fixed to the adjustable handle;

a gear assembly interfaced with the gear axle; and a set of brackets protruding from the joining plate.

18. The tension adjustment mechanism according to claim 15, wherein the adjustable handle is rotating coupled to the gear axle and supported by the set of brackets.

19. The tension adjustment mechanism according to claim 15, wherein the gear assembly further comprising a gear and a threading portion to correlate the gear driven by rotating the adjustable handle.

20. The tension adjustment mechanism according to claim 15, wherein the cylindrical shaft further comprising one or more holes and a receptacle to cinch the cable on the cylindrical shaft.

21. A tension adjustment mechanism for a tensioning system for tuning one or more tunable vibrating membrane on a drum shell, the tension adjustment mechanism comprising:

a plate attached to the drum shell;

a winding post attached to the plate, wherein the winding post further comprises:

a cylindrical shaft, configured to spool a cable;

a planetary gear attached to the plate and engaged to the winding post; and an adjustable handle attached to the plate and engaged to the planetary gear.

* * * * *